US006800036B2

(12) United States Patent
Rohan-Weaver

(10) Patent No.: US 6,800,036 B2
(45) Date of Patent: Oct. 5, 2004

(54) GOLF SWING POSITION TRAINER TEACHING A GOLFER TO SWING A GOLF CLUB CORRECTLY

(75) Inventor: John W. Rohan-Weaver, Clermont, FL (US)

(73) Assignee: Julian C. Renfro, Winter Park, FL (US); part interest ( * ) Notice: Subject to any disclaimer, the term of this patent is extended or adjusted under 35 U.S.C. 154(b) by 0 days.

(21) Appl. No.: 10/408,041

(22) Filed: Apr. 7, 2003

(65) Prior Publication Data

US 2003/0190971 A1 Oct. 9, 2003

Related U.S. Application Data

(63) Continuation-in-part of application No. 10/108,001, filed on Mar. 28, 2002, now abandoned.

(51) Int. Cl.[7] ..... A63B 69/36
(52) U.S. Cl. ..... 473/219
(58) Field of Search ..... 473/219, 226, 473/227, 228, 274, 275, 276

(56) References Cited

U.S. PATENT DOCUMENTS 3,462,155 A * 8/1969 Pelz ..... 473/238
3,874,668 A * 4/1975 Flege ..... 473/227
3,954,271 A * 5/1976 Tredway, Sr. ..... 473/212
4,511,147 A * 4/1985 Olsen ..... 473/203
4,944,516 A * 7/1990 Bickler ..... 473/227
5,009,426 A * 4/1991 Cox ..... 473/227
5,127,650 A * 7/1992 Schneller ..... 473/204
5,328,185 A * 7/1994 Finnigan et al. ..... 473/294
6,190,266 B1 * 2/2001 Pamias ..... 473/294

* cited by examiner

*Primary Examiner*—Nini F. Legesee
(74) *Attorney, Agent, or Firm*—Julian C. Renfro, Esq.

(57) ABSTRACT

A golf swing position trainer for teaching a golfer to swing a golf club correctly, without involving the striking of a golf ball. This device is constructed of rigid material, with a handle at one end enabling the golfer to grasp the device with both hands and move it in the general manner of a golf club. The handle portion together with an intermediate leg portion form an arcuately shaped portion, with a relatively small U-shaped portion in effect forming a continuation of the intermediate leg portion. The relatively small U-shaped portion is disposed in an orthogonal relationship with the plane of the arcuately shaped portion. A positioning reference in effect forms a continuation of the relatively small U-shaped portion, with this positioning reference pointing away from the handle portion and serving to indicate to the golfer at one part of the swing, the line of sight to the target.

20 Claims, 4 Drawing Sheets

FIG 1
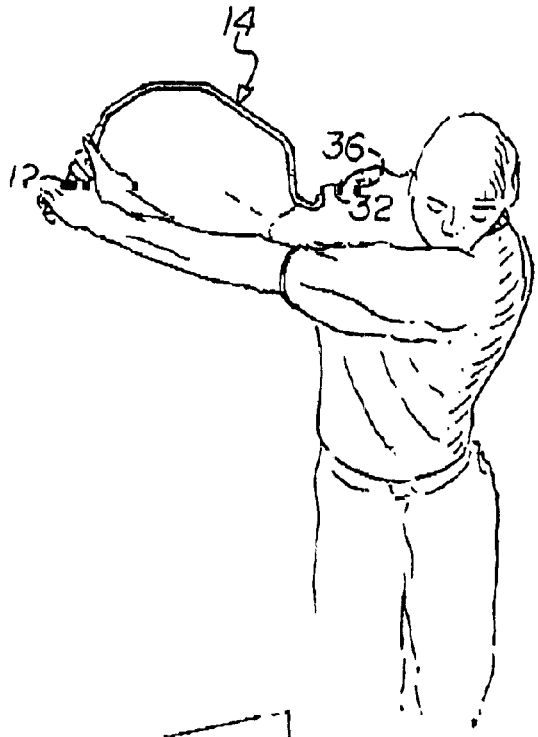
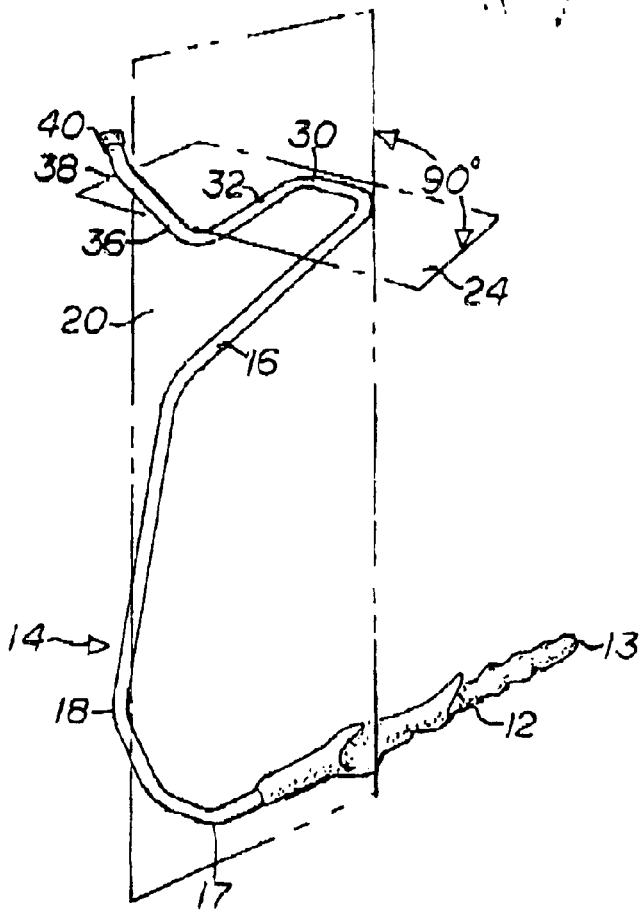
FIG 5

GOLF SWING POSITION TRAINER TEACHING A GOLFER TO SWING A GOLF CLUB CORRECTLY

RELATIONSHIP TO PRIOR INVENTION

This is a Continuation-in-Part of pending application "Golf Swing Position Trainer For Training a Golfer to Swing a Golf Club Correctly," Ser. No. 10/108,001, filed Mar. 28, 2002 now abandoned, with the filing of this application.

BACKGROUND OF THE INVENTION

In the past, a number of devices have been proposed for use by golfers, to aid them in developing and improving their swings. Unfortunately, many of the prior art devices concerned with the swing of the club have been expensive to purchase and/or difficult to use. As a consequence, these devices have not gained much favor with a large number of golfers.

The Strahan U.S. Pat. No. 3,351,346 entitled "GOLF SWING TRAINING DEVICE" teaches the use of weighted components on a shaft used for helping a golfer develop his swing. Strahan mentions that it is the goal of his device to provide a golf swing training device for teaching a golfer to perfect an inside-out swing of a golf club, but his device bears little relation to the present invention.

The Pelz U.S. Pat. No. 3,462,155 entitled "GOLF CLUB HAVING MEANS OF ALIGNING RELATIVE TO A USER" is of marginal pertinence to the instant invention inasmuch as it is a putter type device, having a club head equipped with a striking face designed to contact a golf ball, rather than being strictly a training device bearing some degree of relationship to the present invention, by the use of which a ball is not struck.

The Flege U.S. Pat. No. 3,874,668 entitled "PENDULUM GOLF PUTTER" is another device involving the use of a club head that during use is designed to contact a golf ball, rather than being a golf swing position trainer advantageously configured to in effect force the golfer to maintain his or her hands, arms, shoulders and hips in a desirable and effective relationship during the swing.

The Richards U.S. Pat. No. 4,381,111 entitled "GOLF SWING SIMULATOR DEVICE" is an elaborate device that would be expensive to produce and difficult to use. This patent would solve few of the problems with golf swing that are solved by the use of the instant invention.

The Olsen GOLF SWING TRAINING CLUB, U.S. Pat. No. 4,511,147, has a weighted head but fails to deal with the important matter of the positioning of the golfer's hands relative to his torso.

The DeBack U.S. Pat. No. 5,209,481 entitled "GOLF SWING MUSCLE STRENGTHENER AND SWING DEVELOPER DEVICE" is another instance of the use of weights for developing a golfer's swing. However, only a few golfers would be able to use such heavy weights.

SUMMARY OF THE INVENTION

In designing my novel golf swing position trainer, I was mindful of the fact that many golfers tend to develop golf swings that are inconsistent with the ball being hit squarely, and having it travel in the expected direction. To this end I have designed a device intended to teach the fundamentals of the golf swing to a golfer, without this novel device being intended to actually strike a golf ball. My golf swing position trainer is advantageously configured to in effect force the golfer to maintain his or her hands, arms, shoulders and hips in a desirable and effective relationship during the swing.

My novel device is manifestly intended for use by males as well as females, and for left handed golfers as well as right handed golfers, but for the purpose of simplifying the description, I intend, when using the personal pronouns his or him, to include the fact that the golfer may be female, where the pronouns hers or her would normally apply. Also, it will later be seen that I have illustrated my novel device in use by a right handed golfer inasmuch as something more than 85% of the world's population is believed to be right handed. Quite obviously, my device will manifestly be marketed for left handed as well as right handed golfers, and the descriptive portions appearing herein that specifically mention right handed golfers are clearly not intended to preclude the use of a suitably configured version of my invention by a left handed golfer.

The golf swing position trainer I have developed is preferably constructed of a single piece of stiff material, that has been configured into a compound curvature designed to provide vision and feel references for enabling the golfer to achieve the correct golf swing position movement and ultimately improve his golf swing.

More specifically, my golf swing position trainer has a handle portion attached at a first end of the device, with a positioning reference located at the other end of the device. The handle portion is configured to cause the golfer to hold the position trainer in the appropriate manner for the position trainer to be moved with both hands in the general manner of a golf club. The handle portion represents a component of a relatively large U-shaped or arcuately-shaped portion of the position trainer, with an intermediate leg portion of the position trainer representing another part of the relatively large U-shaped portion. The intermediate leg portion resides in approximately the same plane as the handle portion and is disposed somewhat less than 180° away from the handle portion.

A second, relatively small U-shaped portion of the position trainer in effect forms a continuation of the intermediate leg portion, with a smooth curve being formed at the location where these portions join. The second, relatively small U-shaped portion is disposed in a plane residing in approximately an orthogonal relationship with the plane of the relatively large U-shaped portion. It is a part of the relatively small U-shaped portion that is to be maintained by the golfer against the biceps of one of his arms during a significant part of his swing, thus assuring the golfer's hands, wrists, arms and shoulders being maintained at a proper relationship to the chest portion of the golfer.

The second end of the position trainer represents the previously mentioned positioning reference, which is relatively short and in effect forms a continuation of the relatively small U-shaped portion. The positioning reference is disposed at approximately a 45° angle to the plane of the relatively small U-shaped portion and points generally away from the handle portion. The positioning reference provides important visual as well as feel references to the golfer, and at one part of the swing of the position trainer, the positioning reference indicates to the golfer, the line of sight to the target. By line of sight to the target I mean a line to a point selected by the golfer, such as a location on the middle of the fairway, or the cup on the green.

A recent improvement to my position trainer involves a modification of the curvature located at the end of the device that is remote from the handle. This modified configuration involves approximately the last inch and one-half of the device remote from the handle being additionally bent, which allows the left wrist of a right handed golfer a more neutral position, which correlates into a club face that is more nearly square when the club is at the top of the swing.

Another recent modification of my novel golf swing position trainer involves the creation of an additional bend formed in the immediate vicinity of the handle, with this additional bend allowing the upper end of my device to stay in close contact with the golfer's biceps region during the downswing transition, thus assuring comfortable contact. I have found that this additional bend minimizes unwanted tension in the left arm of a right handed golfer during the start of the downswing, or during the downswing transition.

It is thus to be seen that I have provided a readily transportable position trainer device effective in causing the golfer to maintain the club handle in the appropriate relationship to his or her upper body throughout the swing of the club, with no contact of the trainer device with a golf ball being involved.

It is therefore a principal object of this invention to provide a golf swing position trainer that is uncomplicated, affordable, easy to utilize, and highly effective in helping a beginning or intermediate golfer develop a highly effective swing.

It is another object of this invention to provide a golf swing position trainer configured into a compound curvature providing vision and feel references to enable the golfer to achieve the correct golf swing position movement and ultimately improve his golf swing.

It is still another object of this invention to provide a golf swing position trainer that incorporates positive transfer training, or in other words, enables highly effective motor skill learning.

It is yet still another object of my invention to provide a novel device that, if used for approximately ten minutes per day, can help the golfer achieve effective motor skill learning of the ideal golf swing.

It is yet still another object of this invention to provide a golf swing position trainer of single piece, rigid construction that is configured to maintain a desirable relationship with the golfer's biceps during a portion of the swing, and thus assure the hands of the golfer being maintained at a desired distance from his chest during the swing, and his wrists, arms and shoulders in a highly desirable and effective relationship without the extended arm being under tension.

It is yet still another object of this invention to provide a golf swing position trainer that can readily be manufactured for use either by a left handed or a right handed golfer.

These and other objects, features and advantages will become more apparent as the description proceeds.

BRIEF DESCRIPTION OF DRAWINGS

FIG. 1 is a view showing my novel golf swing position trainer in use by a right handed golfer, with this view illustrating how the positioning reference portion of my device is brought into contact with the biceps muscles of the golfer during the upward part of the backswing;

FIG. 5 is a perspective view generally along the lines of FIG. 2, but revealing the important fact that the plane of the large U-shaped portion in which the handle is disposed, is in an orthogonal relationship to the plane of the relatively small U-shaped portion.

DETAILED DESCRIPTION

A golf swing position trainer in accordance with this invention is adapted to train a golfer to swing a golf club correctly, with an exemplary version of my invention being illustrated in FIG. 1, where it has been placed in use by a right handed golfer. As easily seen in this figure as well as in FIG. 2, my position trainer 10 is constructed essentially of a single piece of rigid material, and is configured to have first and second ends. By way of example, I prefer to use an aluminum rod of 6063 aluminum that is ½" in diameter in constructing my novel device, but I obviously am not to be limited to this. As an alternative, an industrial grade, rigid plastic could be used when cost is a factor.

An important ancillary portion of my device is represented by handle portion 12, which is affixed over the first end of my device. The handle portion is typically molded of non-metallic material, such as industrial grade plastic. The handle portion 12 is carefully configured to enable the golfer to grasp the handle portion in a particular relationship with respect to the remaining portion of the swing position trainer. Upon the handle being grasped correctly with both hands, my novel position trainer can be moved or swung in the manner of a golf club, as generally indicated in FIG. 1 as well as in related FIGS. 6 through 11, but it must be borne in mind that the position trainer is not intended to be brought into direct contact with a golf ball.

Figure 2:
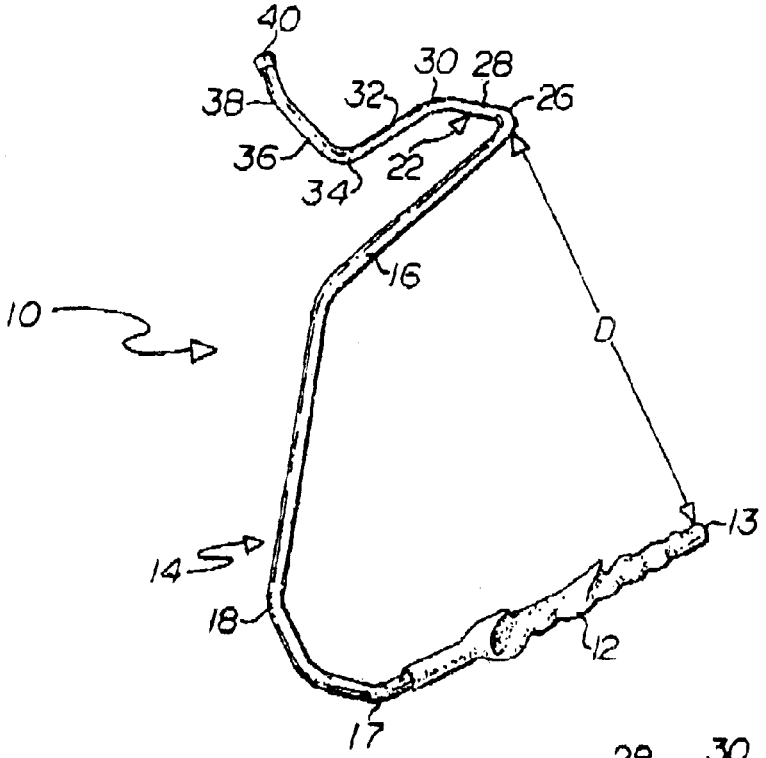
FIG. 2 is a perspective view of my golf swing position trainer, showing the relative positions of several of the significant bends in a device configured for use by a right handed golfer.

It is to be seen from FIG. 2 that the handle portion 12 is affixed to a component of a relatively large U-shaped or arcuately-shaped portion 14 of the position trainer, with an intermediate leg portion 16 of the position trainer representing another important part of the relatively large U-shaped portion 14. The intermediate leg portion 16 resides in approximately the same plane as the handle portion 12 and is disposed somewhat less than 180° away from the handle portion 12. This plane in which the handle portion 12 and the intermediate leg portion 16 reside is shown as plane 20 in FIG. 5.

It is to be noted from FIGS. 2 and 5 that relatively close to the handle 12 are bends 17 and 18, with bend 17 being important from the standpoint of enabling the left arm of a right handed golfer to remain extended and relatively tension-free when using my device. I have found that a tension-free, extended left arm is essential for success in the case of a right handed golfer, with a tension-free, extended right arm being essential in the case of a left handed golfer.

From FIG. 2 it will also be seen that a second, relatively small U-shaped portion 22 of my position trainer in effect forms a continuation of the intermediate leg portion 16. It is important to note that the relatively small U-shaped portion 22 is disposed in a plane 24 that resides in an orthogonal relationship to the plane 20 in which the large U-shaped member 14 is disposed; note FIG. 5. As clearly seen in FIG. 3, a smooth curve 26 is formed at the location where the two U-shaped portions 14 and 22 join.

As will be noted from FIG. 2, the curve 26 representing the juncture of the two U-shaped portions is spaced a distance D from the end 13 of the handle 12, with this distance being between 12" and 22", preferably 16". It is to be noted that the distance D is important for enabling the golfer to achieve proper wrist set and, for a right handed golfer, left arm extension achieved without tension. My novel golf swing position trainer can be made in a range of sizes, with devices constructed to have a relative small dimension D being intended for use by a juvenile or a lady of petite stature. Devices configured to have a larger dimension D are intended for use by adult males.

It is to be understood that if the golfer's extended arm is bent excessively, this will cause an early release or casting of the club head, which in turn causes a slice. None of the known prior art is designed to prevent the excessive bending of the extended arm, which error I believe to be the primary cause of the slicing of a golf ball by a golfer.

Figure 4:
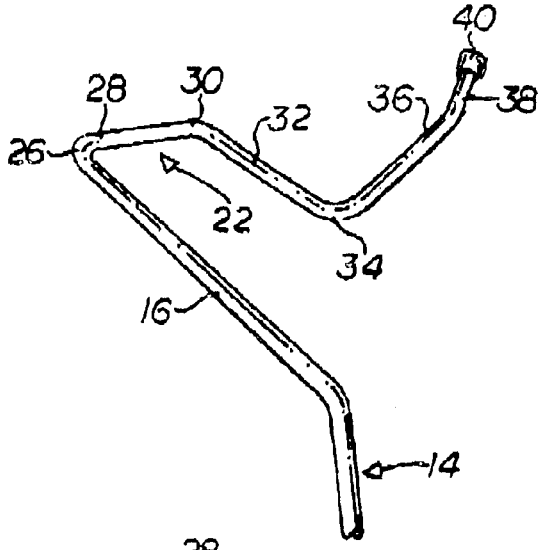
FIG. 4 is a perspective view similar to FIG. 3, but here showing the relationship of the positioning reference to the remaining portions of the position trainer when the device has been configured for use by a left handed golfer.
Figure 3:
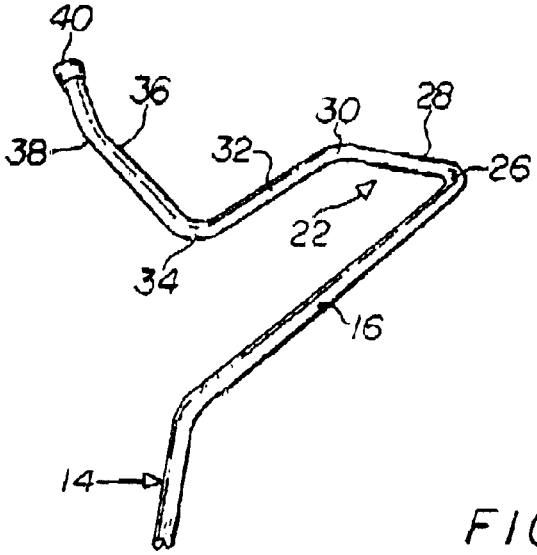
FIG. 3 is a perspective view to a larger scale of the upper portion of my golf swing position trainer, showing in the case of a device configured for a right handed golfer, the relationship of the positioning reference relative to the member by which it is supported.

With particular reference to FIGS. 2, 3 and 4, what may be regarded as the base portion 28 of the relatively small U-shaped member 22 is preferably approximately 5" in length, with the base portion 28 blending into a smooth curve 30 that is connected to a short leg 32. The short leg 32 represents what may be regarded as the remaining part of the relatively small U-shaped portion 22, with the curved end portion 34 of the leg 32 serving as the support member for the positioning reference 36; note FIGS. 3 and 4 in particular. The short leg 32 may be approximately 4½" in length, and the positioning reference may be 5" in length, but I obviously am not to be limited to these dimensions.

The positioning reference 36 is of course the second end of my novel position trainer, with the positioning reference being seen in FIGS. 2 and 3 to be relatively short and in effect forming a continuation of the relatively small U-shaped portion 22. The positioning reference 36 forms a significant portion of my device and is disposed at approximately a 45° angle to the plane 24 of the relatively small U-shaped portion 22 (note FIG. 5), and points generally away from the handle portion 12. The positioning reference 36 serves, at one part of the swing of the position trainer, to indicate the line of sight to the target, and at other times this important member serves as a feel reference greatly aiding the golfer in his swing. By feel reference I mean the golfer is able to feel the position of members 32, 36 and 38 on his upper arm, somewhere between the shoulder and the elbow joint. This contact serves to assure the golfer at the top of his backswing that the backswing has been executed correctly, with sufficient left arm extension in the case of the right handed golfer.

Figure 8:
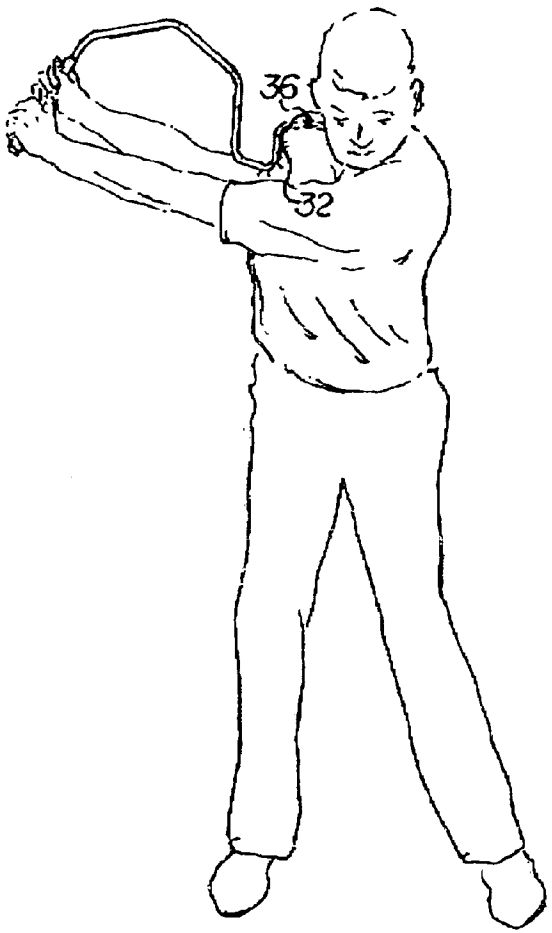
FIGS. 6 through 11 are relatively small views illustrating six steps that characterize a golfer's use of my device.
Figure 9:
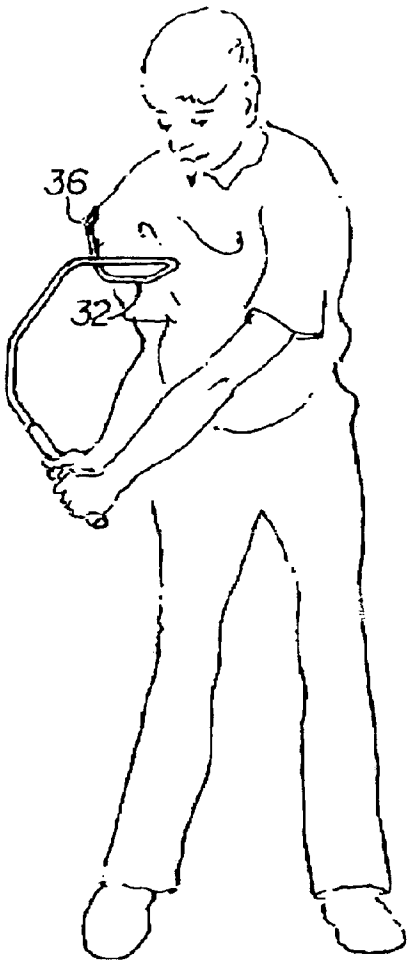

The feel the golfer has from the top of the backswing to the transition, best illustrated by referring to FIGS. 8 and 9, is vital in that it provides and guides the golfer in the proper downswing motion. Without this feel reference provided by my novel golf swing position trainer, the golfer might well release his bent right arm before the transition position, which will likely bring about mis-hitting the golf ball.

With particular reference now to FIG. 3, representing the configuration of my golf swing position trainer used for a right handed golfer, and to FIG. 4, the configuration used for a left handed golfer, it is to be noted that the final end of the positioning reference 36 involves a further bend 38, such that the outer tip 40 of my device is bent to an additional extent. This outer tip portion 40 may be some 1½ inches in length, with this further bend allowing a more precise backswing position of the golfer. The further bend 38 contributes importantly to the left wrist of a right handed golfer assuming a more neutral position, which correlates into a squarer club face at the top of the swing.

Referring back to FIG. 1, it will be noted from this figure that the short leg 32 is in contact with the biceps of the right arm, and the positioning reference 36 is in contact with the outer portion of the upper arm of this right handed golfer when the position trainer has been moved by the golfer into an upper part of his backswing.

Figure 6:
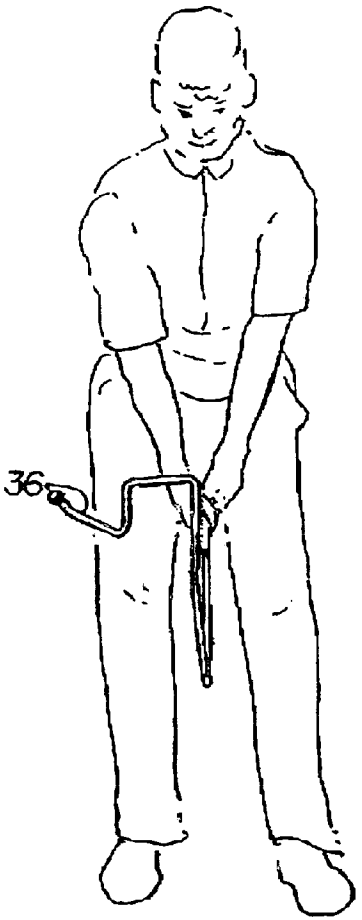

With particular reference now to related FIGS. 6 through 11, it will be seen that FIG. 6 may be regarded as representing Step 1 of the utilization by a golfer of my device. As part of Step 1, the golfer stands in the setup or address position, with his feet shoulder width apart, his knees locked. The golfer should be bent at his hips, pushing his buttocks out while keeping the back straight.

At this time the golfer should make sure that the positioning reference 36 is at a 45° angle to the line of sight to the target, called the target line. As previously mentioned, by line of sight to the target I mean a line to a point selected by the golfer, such as a location in the middle of the fairway, or the cup on the green. Because of the provision of my novel positioning reference, the golfer is aided in positioning his wrists in the proper position for the start of the golf swing. Before commencing the swing the golfer unlocks his knees and places his hands in a centered relationship to his body.

Figure 7:
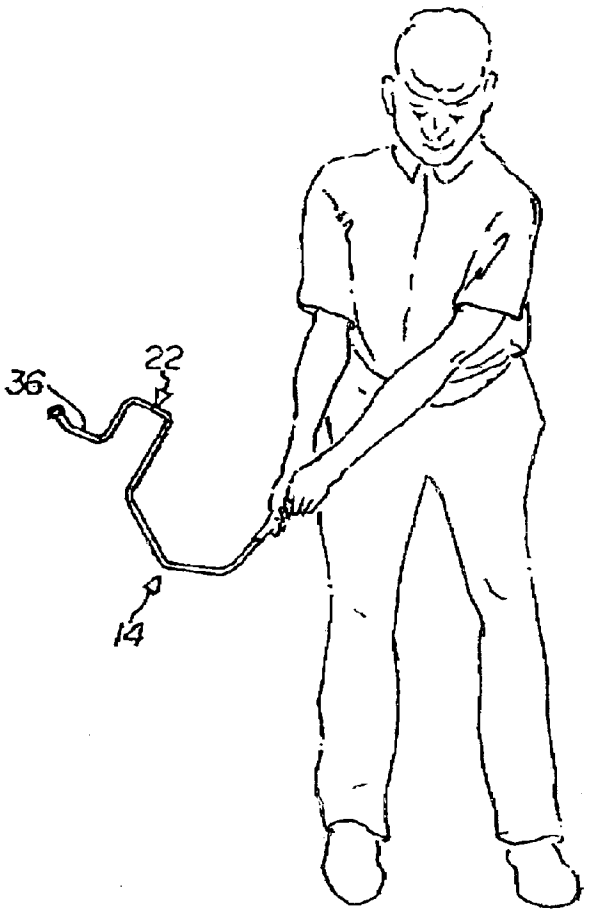

Referring now to FIG. 7, it is to be understood that in this figure Step 2, known as the take away, is depicted. The take away is started by the golfer rotating his upper body until the positioning reference is parallel to the target line as viewed by the golfer, using his peripheral vision. This alignment of the positioning reference with the target line assures what a golfer would describe as a perfect on-plane take away.

With reference to FIG. 8, representing Step 3, the right handed golfer continues to rotate his upper body in the backswing direction while hinging his left wrist up, and his right wrist back. For the right handed golfer, his right elbow is bent until the short leg 32 rests against the golfer's right biceps somewhere between the shoulder and the elbow joint, and the positioning reference 36 resides close by, against an outer portion of the golfer's arm. Step 3 is a very important step in that the use of my novel device has caused the right handed golfer to extend his left arm without tension and fully hinge his wrists. A full width turn has been achieved.

With reference to FIG. 9, representing Step 4, the golfer has been maintaining the short leg 32 and the positioning reference in contact with the upper portion of his arm, and at this time he starts the downswing, with the lower body moving toward the target and the arms lowering to achieve the power slot. At this moment the left arm is at a 45° angle to the ground, and at this time the maximum power is delivered from the golf swing.

Figure 10:
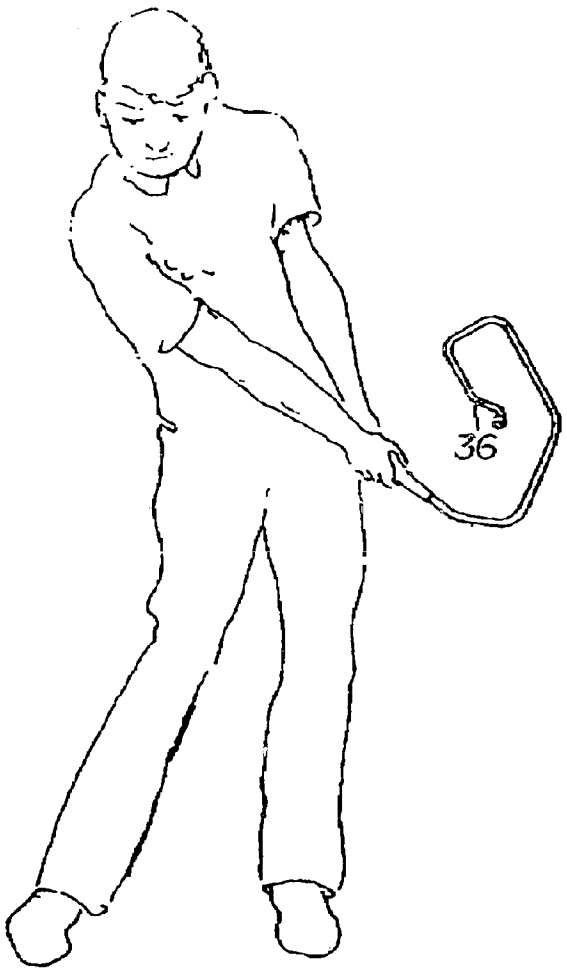

With regard to FIG. 10, representing Step 5, the release, the positioning reference has moved far away from the right biceps muscles and past the left thigh until the positioning reference is at a 90° angle to the target line, guaranteeing a full release.

Figure 11:
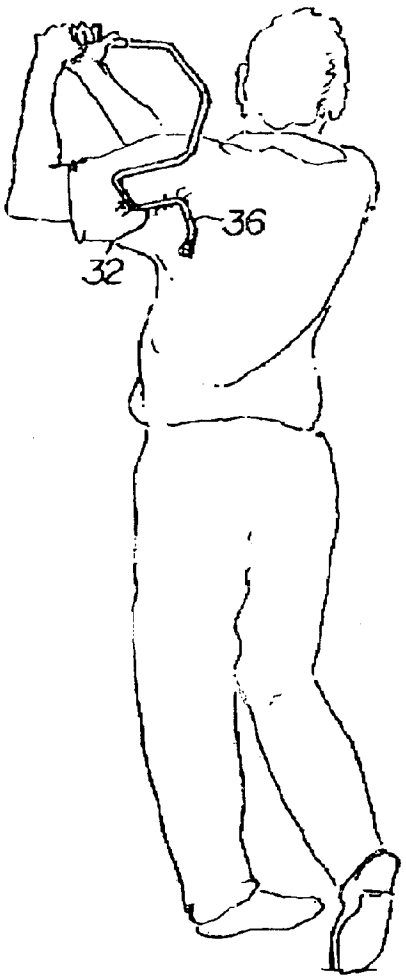

With regard to FIG. 11, representing Step 6, the finish, the upper body has rotated to the left of the target, allowing the right foot to come up onto the big toe. While hinging his left wrist up, the left elbow is bent, bringing the positioning reference over the left shoulder, resting it and the support member 32 on the upper left back to a completely balanced full finish.

It is to be noted that as a consequence of the use of rigid material in the construction of my position trainer, the handle portion of my device and consequentially the golfer's hands will remain in a desirably spaced, consistent relationship to the golfer's upper body throughout the golf swing.

It will now be apparent that I have designed a golf swing position trainer that is inexpensive and relatively easy to use, yet enabling positive transfer training, or in other words, my device advantageously makes highly effective motor skill learning readily possible. It is important to recall that my golf swing position trainer is not designed to strike a golf ball. I have found that if a golfer practices with my novel device for approximately ten minutes per day, this will help him (or her) achieve effective motor skill learning of the ideal golf swing.

Viewing my invention from a slightly different perspective, my device is responsible for training the golf club to react to the movement of the body rather than the body reacting to the movement of the golf club.

I regard as key features of the utilization of my golf swing position trainer, the fact that it assures, in the case of a right handed golfer, the extension of the left arm without tension at the top of the backswing, and the maintaining of the proper wrist and right arm angles during the transition position, that is, during the first part of the downswing.

I claim:

1. A golf swing position trainer for teaching a golfer to swing a golf club correctly, said position trainer being constructed essentially of a single piece of rigid material, said position trainer configured to have a handle portion at one end, enabling the golfer to grasp the handle portion and move the position trainer with both hands in the general manner of a golf club, the part of said position trainer having the handle portion being a component of a relatively large U-shaped portion, with an intermediate leg portion of said position trainer representing another part of the relatively large U-shaped portion, said intermediate leg portion residing in approximately the same plane as said handle portion and disposed approximately 180° away from said handle portion, a second, relatively small U-shaped portion in effect forming a continuation of said intermediate leg portion, with said second, relatively small U-shaped portion disposed in a plane residing in approximately an orthogonal relationship with the plane of said relatively large U-shaped portion, and a positioning reference portion of said position trainer, said positioning reference forming a continuation of said relatively small U-shaped portion, being disposed at an angle thereto, and in effect forming the opposite end of said position trainer with regard to said handle portion, said positioning reference pointing away from said handle portion and providing a feel reference to the golfer at one part of the golfer's swing.

2. The golf swing position trainer as recited in claim 1 in which one part of said relatively small U-shaped portion is adapted to contact the biceps of one arm of the golfer when said position trainer has been moved by the golfer into an upper part of his backswing.

3. The golf swing position trainer as recited in claim 1 wherein said handle portion is configured to closely receive the hands of the golfer, so as to uniquely determine the attitude in which the position trainer is grasped and moved by the golfer.

4. The golf swing position trainer as recited in claim 1 in which as a consequence of the rigid material utilized in the construction of said position trainer, said handle portion will remain in a desirable, properly spaced relationship to the golfer's upper body throughout the golf swing.

5. The golf swing position trainer as recited in claim 1 in which a relatively short positioning reference forms in effect a continuation of said relatively small U-shaped portion and points generally away from said handle portion, said positioning reference being disposed at approximately a 45° angle to the plane of said relatively small U-shaped portion.

6. The golf swing position trainer as recited in claim 5 in which said trainer is adapted to be swung in the manner of a golf club, starting with an address or setup position, with the golfer being aided in positioning his wrists properly for the start of the back swing by observing when said positioning reference is residing at a 45° angle to the line of sight to the target.

7. The golf swing position trainer as recited in claim 5 in which the golfer, when commencing a backswing or takeaway while holding the position trainer, is aided in rotating his upper body to the appropriate extent by noting, while using his peripheral vision, when said positioning reference is parallel to the target line.

8. The golf swing position trainer as recited in claim 1 in which said relatively small U-shaped portion in effect forming a continuation of said intermediate leg portion is caused to be momentarily disposed in an uppermost position when the golfer is holding said position trainer at the bottom of the golfer's swing.

9. A golf swing position trainer for teaching a golfer to swing a golf club correctly, said position trainer being constructed essentially of a single piece of rigid material, said position trainer configured to have a handle portion at one end, enabling the golfer to grasp the handle portion and move the position trainer with both hands in the general manner of a golf club, the part of said position trainer having the handle portion being a component of a relatively large U-shaped portion, with an intermediate leg portion of said position trainer representing another part of the relatively large U-shaped portion, said intermediate leg portion residing in approximately the same plane as said handle portion and disposed approximately 180° away from said handle portion, a second, relatively small U-shaped portion in effect forming a continuation of said intermediate leg portion, with said second, relatively small U-shaped portion disposed in a plane residing in approximately an orthogonal relationship with the plane of said relatively large U-shaped portion, and a positioning reference portion of said position trainer, said positioning reference being relatively short and in effect forming a continuation of said relatively small U-shaped portion, said positioning reference being disposed at approximately a 45° angle to the plane of said relatively small U-shaped portion, said positioning reference forming the opposite end of said position trainer with regard to said handle portion, and pointing away from said handle portion.

10. The golf swing position trainer as recited in claim 9 wherein said handle portion is configured to closely receive the hands of the golfer, so as to uniquely determine the attitude that the position trainer is moved by the golfer.

11. The golf swing position trainer as recited in claim 9 in which said trainer is adapted to be swung in the manner of a golf club, starting with an address or setup position, with the golfer being aided in positioning his wrists properly for the start of the back swing by observing when said positioning reference is residing at a 45° angle to the line of sight to the target.

12. The golf swing position trainer as recited in claim 9 in which the golfer, when commencing a backswing or takeaway while holding the position trainer, is aided in rotating his upper body to the appropriate extent by noting, while using his peripheral vision, when said positioning reference is parallel to the target line.

13. The golf swing position trainer as recited in claim 9 in which one part of said relatively small U-shaped portion is adapted to contact the biceps of one arm of the golfer when said position trainer has been moved by the golfer into an upper part of his backswing.

14. The golf swing position trainer as recited in claim 9, in which as a consequence of the rigid material utilized in the construction of said position trainer, said handle portion will remain in a desirable, properly spaced relationship to the golfer's upper body throughout the golf swing.

15. A golf swing position trainer for teaching a golfer to swing a golf club correctly, said position trainer being constructed essentially of a single piece of rigid material, said position trainer configured to have first and second ends, with a handle portion formed at said first end, with said handle portion enabling the golfer to grasp the handle portion and move the position trainer with both hands in the general manner of a golf club, said handle portion representing a component of a relatively large U-shaped portion of said position trainer, with an intermediate leg portion of said position trainer representing another part of the relatively large U-shaped portion, said intermediate leg portion residing in approximately the same plane as said handle portion and disposed approximately 180° away from said handle portion, a second, relatively small U-shaped portion in effect forming a continuation of said intermediate leg portion, with said second, relatively small U-shaped portion disposed in a plane residing in approximately an orthogonal relationship with the plane of said relatively large U-shaped portion, said second end of said position trainer representing a positioning reference, said positioning reference being relatively short and in effect forming a continuation of said relatively small U-shaped portion, said positioning reference being disposed at approximately a 45° angle to the plane of said relatively small U-shaped portion and pointing away from said handle portion.

16. The golf swing position trainer for teaching a golfer to swing a golf club correctly as recited in claim 15, said positioning reference serving, at one part of the swing of said position trainer, to indicate to the golfer, the line of sight to the target, and providing a feel reference to the golfer at another part of the swing.

17. The golf swing position trainer as recited in claim 15 in which one part of said relatively small U-shaped portion is adapted to contact the biceps of one arm of the golfer when said position trainer has been moved by the golfer into an upper part of his backswing.

18. The golf swing position trainer as recited in claim 15 wherein said handle portion is configured to closely receive the hands of the golfer, so as to uniquely determine the attitude that the position trainer is moved by the golfer.

19. The golf swing position trainer as recited in claim 15 in which as a consequence of the rigid material utilized in the construction of said position trainer, said handle portion will remain in a desirable, properly spaced relationship to the golfer's upper body throughout the golf swing.

20. A golf swing position trainer for teaching a golfer to swing a golf club correctly, said position trainer being constructed essentially of a single piece of rigid material, said position trainer configured to have first and second ends, with a handle portion formed at said first end, with said handle portion enabling the golfer to grasp the handle portion and move the position trainer with both hands in the general manner of a golf club, said handle portion representing a component of a relatively large U-shaped portion of said position trainer, with an intermediate leg portion of said position trainer representing another part of the relatively large U-shaped portion, said intermediate leg portion residing in approximately the same plane as said handle portion and disposed approximately 180° away from said handle portion, a second, relatively small U-shaped portion in effect forming a continuation of said intermediate leg portion, with said second, relatively small U-shaped portion disposed in a plane residing in approximately an orthogonal relationship with the plane of said relatively large U-shaped portion, said second end of said position trainer representing a positioning reference that in effect forms a continuation of said relatively small U-shaped portion, said positioning reference being relatively short and pointing at an angle away from said handle portion, said positioning reference serving at one part of the golfer's swing to indicate the line of sight to the target.

* * * * *